United States Patent [19]

Jinno et al.

[11] Patent Number: 4,975,075

[45] Date of Patent: Dec. 4, 1990

[54] LOCKING MECHANISM FOR A CONNECTOR

[75] Inventors: Keishi Jinno; Toshiharu Kawashima, both of Shizuoka, Japan

[73] Assignee: Yazaki Corporation, Tokyo, Japan

[21] Appl. No.: 307,284

[22] Filed: Feb. 6, 1989

[30] Foreign Application Priority Data

Feb. 10, 1988 [JP] Japan ..... 63-15688

[51] Int. Cl.[5] ..... H01R 13/627

[52] U.S. Cl. ..... 439/353; 439/357

[58] Field of Search ..... 439/347, 350, 351, 352, 439/353, 354, 355, 356, 357, 358

[56] References Cited

U.S. PATENT DOCUMENTS

| | | | |
|---|---|---|---|
| 3,944,312 | 3/1976 | Koenig | 439/357 |
| 3,950,067 | 4/1986 | Leavesley | 439/358 |
| 4,640,566 | 2/1987 | Matsusaka | 439/350 |
| 4,695,112 | 9/1987 | Maston et al. | 439/350 |

FOREIGN PATENT DOCUMENTS 1238587 7/1971 United Kingdom .

*Primary Examiner*—Neil Abrams
*Assistant Examiner*—Khiem Nguyen
*Attorney, Agent, or Firm*—Krass & Young

[57] ABSTRACT

A locking mechanism for a male/female connector system comprises a flexible locking arm formed on a connector housing. The locking arm has formed at its free end a locking projection which lockingly engages a shoulder on a mating connector housing. The locking arm and locking projection lie below the fulcrum of the locking arm with respect to the connector housing. When forces tending to separate the mated connector housings are applied thereto, a moment is created acting on the locking arm in a direction to strengthen the engagement between the locking projection and the shoulder.

14 Claims, 1 Drawing Sheet

LOCKING MECHANISM FOR A CONNECTOR

FIELD OF THE INVENTION

The present invention relates to a locking mechanism for interfitting connectors, particularly male/female electrical connectors used to connect a wire harness or the like.

BACKGROUND OF THE INVENTION

Connectors comprising interfitting male and female connectors or connector housings are well-known in the art, and such connectors are commonly used for connecting electrical wire harnesses and similar apparatus. It is a problem with such connectors that they can inadvertently be pulled apart or separated during use, breaking the desired connection, electrical or otherwise. To overcome this problem, it has been suggested in the prior art to provide a locking mechanism on one of the connector housings such that when two complementary connector housings are interfitted, it is impossible, or at least very difficult, for them to be inadvertently pulled apart.

One method suggested by the prior art provides the male connector housing with a flexible locking arm projecting from the surface of the housing. The free end of the locking arm is provided with a beveled locking projection adapted to allow the male connector housing to be inserted into a female connector housing, the locking projection engaging a catch or shoulder in the female connector housing to prevent the connectors from being pulled apart. The fulcrum of the flexible locking arm corresponds to the juncture of the locking arm and the surface of the male housing, and the locking arm and locking projection lie above the fulcrum with respect to the housing. The distance between the fulcrum and an extension line of the locking projection running parallel to the locking arm creates a lever arm between the two.

A problem with this prior art locking mechanism is that, when the connector housings are pulled in opposite directions by a force tending to separate them, a moment equal to the magnitude of the force times the length of the lever arm acts upon the locking arm in a direction tending to disengage the locking projection from the catch or shoulder of the female housing. This defeats the purpose of the prior art locking mechanism, making it unsuitable for providing secure locking engagement between the connector housings.

SUMMARY OF THE INVENTION

According to the present invention, a locking mechanism for a male/female connector system provides locking engagement between two mating connector housings in which the locking engagement is strengthened by the action of forces tending to pull the connector housings apart. This is accomplished by way of a flexible locking arm extended longitudinally from its fulcrum with respect to the connector housing, the locking arm having a locking projection formed on its free end and directed toward the fulcrum. The locking arm and locking projection lie to one side of an extension line of the fulcrum with respect to the locking arm. An interval defining a lever arm separates the locking projection and the extension line of the fulcrum. The extension line bisects the fulcrum and extends parallel to the locking arm. Forces tending to pull the mated connector housings apart act through the lever arm on the locking arm to create a moment in a direction which strengthens the locking engagement between the two connector housings.

In one embodiment of the invention, at least one support member is formed on the surface of the connector housing to define a fulcrum. The flexible locking arm is supported at one end by the support member and extends longitudinally from the fulcrum with respect to the housing. The locking projection formed on the opposite end of the locking arm is directed toward the support member, i.e. it is formed on the side of the locking arm closest to the extension line of the fulcrum and actually extends toward the fulcrum. If an extension line is drawn from the fulcrum running along and parallel to the locking arm, an interval exists between the locking portion and the extension line defining an effective lever arm.

In the illustrated embodiment of the invention, a support member is formed on each side of a longitudinal groove or channel running longitudinally along the upper surface of the connector housing. The support members define a fulcrum and support the flexible locking arm within the channel. The locking projection is a beveled member formed on the free end of the locking arm and directed toward the extension line of the fulcrum in the above-described manner, lying below the fulcrum extension line with respect to the connector housing surface. The locking projection is designed to frictionally engage a catch or shoulder portion formed on a mating connector housing. When forces tending to separate the mated connector housings are applied thereto, the arrangement of the locking arm and locking projection below the extension line of the fulcrum with respect to the connector housing creates a moment in a direction which strengthens the engagement of the locking portion and the catch or shoulder portion.

The locking mechanism of the present invention makes it virtually impossible for mated connector housings to be inadvertently pulled apart. Further features and advantages of the invention will become apparent upon continued reading of the specification.

BRIEF DESCRIPTION OF THE ILLUSTRATED EMBODIMENT

DETAILED DESCRIPTION OF THE ILLUSTRATED EMBODIMENTS

Figure 1:
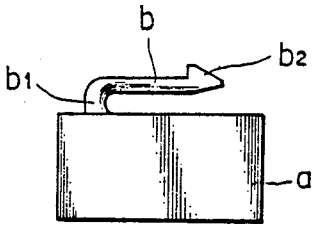
FIG. 1 PRIOR ART
FIG. 1 is a side view of a locking arm formed on a connector housing according to the prior art.
Figure 2:
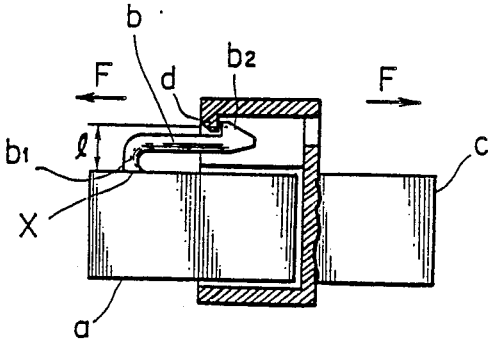
FIG. 2 PRIOR ART
FIG. 2 is a sectional side view of the prior art locking mechanism lockingly engaging mated male/female connector housings.

Referring to FIGS. 1 and 2, a locking mechanism according to the prior art comprises a flexible locking arm B connected to a connector housing at base portion $B_1$. A locking projection $B_2$ is formed on the free end of $B_1$, opposite the surface of the connector housing A and opposite the fulcrum point X of locking arm B located at the junction of base portion $B_1$ and connector housing A. A distance L separates fulcrum point X and the extension line of engaging projection $B_2$. Locking arm B, base portion $B_1$ and locking projection $B_2$ typically comprise plastic or rubber integrally molded with the connector housing.

Locking projection $B_2$ is beveled to permit male connector housing A to be inserted into female connector housing C. Once inserted, the flat, non-beveled surface of locking projection $B_2$ frictionally engages shoulder D of housing C. However, when longitudinal forces F are applied to the mated housings, the forces act through lever arm L to create a moment acting on locking arm B in a direction tending to separate locking projection $B_2$ and shoulder D. When this occurs, the prior art locking mechanism fails, and housing A may become separated from housing C.

Figure 3:
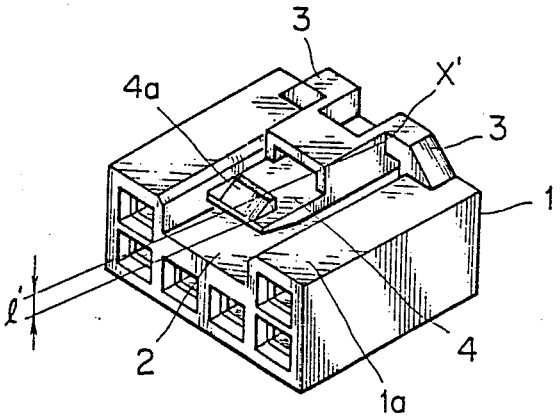
FIG. 3 is a perspective view of a male electrical connector housing provided with the locking mechanism of the present invention.
Figure 4:
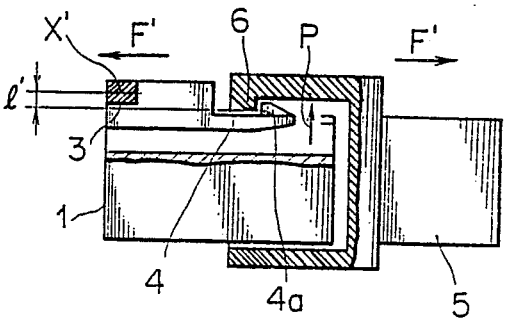
FIG. 4 is a partial sectional view of the locking mechanism of FIG. 3 lockingly engaging mated male/female connector housings.

Referring now to FIGS. 3 and 4, the novel locking mechanism of the present invention is shown. A male connector housing 1 for an electrical wire harness has a longitudinal channel 2 formed in its upper surface 1*a*. Two support members 3 are formed on upper surface 1*a* immediately adjacent channel 2 rearwardly of the front face 1*b* of housing 1. Support members 3 serve to support a flexible locking arm 4 at one end within channel 2. Locking arm 4 runs longitudinally of housing 1 in the direction in which male connector housing 1 is connected to a female housing 5. A beveled locking projection 4*a* is formed on the free end of locking arm 4, beveled upward and back toward support members 3.

The locking mechanism of the present invention may comprise almost any suitable material or combination of materials, but in this illustrated embodiment it preferably comprises a resilient plastic integrally molded with male connector housing 1. If desired, the locking mechanism may be formed separately from the male connector housing and subsequently attached thereto.

The fulcrum X of locking arm 4 is defined at the upper portions of support members 3 where they meet with locking arm 4. Fulcrum X lies above locking arm 4 and locking projection 4*a* with respect to housing 1, a vertical distance 1 separating locking projection 4*a* and an extension line of fulcrum X running parallel to the locking arm. As can clearly be seen in the drawings, locking projection 4*a* is formed on the upper surface of locking arm 4 directed or beveled toward fulcrum X.

When male connector housing 1 is inserted in female connector housing 5, the flat, non-beveled surface of locking projection 4*a* frictionally engages shoulder 6 to prevent withdrawal of male housing 1 from female housing 5. When separating forces F are applied to the mated housings in a direction to separate them, the forces act through effective lever arm 1 to create a moment acting on locking arm 4. Because both locking arm 4 and locking projection 4*a* lie below fulcrum X with respect to the male connector housing 1, and because locking projection 4*a* is directed toward fulcrum X, the moment acts on locking arm 4 in the direction of arrow P. The moment acting in the direction of arrow P forces locking projection 4*a* into tighter engagement with shoulder 6, strengthening the locking engagement therebetween. In effect, the locking engagement between the two housings becomes stronger rather than weaker when separating forces try to pull the two apart.

Male connector housing 1 and female connector housing 5 can be voluntarily separated by first depressing locking arm 4 to disengage locking projection 4*a* and shoulder 6, and then pulling the housings apart. During normal use, however, the locking mechanism of the present invention makes it virtually impossible for the connector housings to be inadvertently pulled apart.

It is to be understood that the illustrated embodiment is a specific embodiment in accordance with 35 USC 112, and is not intended to be limiting. The locking mechanism of the present invention may comprise various materials and take various forms and still lie within the scope of the claims. The locking mechanism of the present invention is not limited to electrical connectors, but can be used to lockingly engage almost any type of mating connectors. The locking arm of the present invention may be formed on either the male or female connector housing. The locking projection of the present invention may take almost any suitable form.

I claim:

1. A locking mechanism to secure an electrical connector housing comprising:

a flexible locking arm on the connector housing having a fulcrum, said locking arm extended from said fulcrum longitudinally of said housing;

a locking projection formed on the free end of said locking arm and directed toward said fulcrum; and said free end of said locking arm and said locking projection lying to one side of an extension line of said fulcrum with respect to said locking arm, said extension line passing through said fulcrum and extending parallel to said locking arm, whereby said locking projection is directed toward said extension line of said fulcrum.

2. Apparatus as defined in claim 1, wherein said locking arm is formed on a male connector housing.

3. Apparatus as defined in claim 1, wherein said locking arm frictionally engages an engaging portion formed on a female connector housing when said male and female connector housings are mated.

4. Apparatus as defined in claim 1, wherein said locking projection comprises a beveled catch.

5. Apparatus as defined in claim 1, wherein said locking arm extends from said fulcrum longitudinally along said connector housing in substantially the same direction in which said housing is connected to a mating housing.

6. A locking mechanism to secure an electrical connector housing comprising:

at least one support member formed on a surface of the connector housing to define a fulcrum;

a flexible locking arm supported at one end by said support member and extending from said support member longitudinally along said housing; and a locking projection formed on the opposite end of said locking arm and directed toward said support member such that said locking projection lies to one side of and is directed toward an extension line of the fulcrum with respect to said locking arm, said extension line passing through said fulcrum and extending parallel to said locking arm.

7. Apparatus as defined in claim 6, wherein said locking arm is formed on a male connector housing.

8. Apparatus as defined in claim 7, wherein said locking arm frictionally engages an engaging portion formed on a female connector housing when said male and female connector housings are mated.

9. Apparatus as defined in claim 6, wherein said locking projection comprises a beveled catch.

10. In a male/female connector system comprising male and female connectors adapted to be engaged longitudinally of one another, a locking mechanism to secure said connector system comprising:

a longitudinal channel formed on a surface of the housing of one of said connectors;

at least one support member formed on the surface of said connector housing adjacent said channel to define a fulcrum;

a flexible locking arm disposed within said channel and supported at one end by said support member;

a locking projection formed on the opposite end of said locking arm and directed toward said support member;

said locking arm and locking projection lying below said fulcrum with respect to said housing such that said locking projection lies to one side of and is directed toward extension line of said fulcrum with respect to said locking arm, said extension line passing through said fulcrum and extending parallel to said locking arm;

an engaging portion formed on the housing of the other of said connectors adapted to frictionally engage said locking portion when said connectors are connected; and a moment created through said lever arm when a force tending to separate said male and female connectors is applied to said system, said moment acting on said flexible locking arm in a direction to strengthen the engagement of said locking projection and said engaging portion.

11. Apparatus as defined in claim 10, wherein one of said support members is formed on each side of said channel to support said locking arm within the channel.

12. Apparatus as defined in claim 11, wherein said channel and said locking arm are formed on a male connector housing.

13. Apparatus as defined in claim 12, wherein said locking arm frictionally engages an engaging portion formed on a female connector housing when said male and female connector housings are mated.

14. Apparatus as defined in claim 10, wherein said locking projection comprises a beveled catch.

* * * * *